US006105603A

United States Patent [19]

Alford

[11] Patent Number: 6,105,603

[45] Date of Patent: Aug. 22, 2000

[54] CLAMPING STRUCTURE FOR AN IRRIGATION HYDRANT VALVE HOUSING

[75] Inventor: Curtis Larry Alford, Greenwood, Miss.

[73] Assignee: Curtis L. Alford, Greenwood, Miss.

[21] Appl. No.: 08/872,748

[22] Filed: Jun. 11, 1997

[51] Int. Cl.[7] ..... E02B 13/02

[52] U.S. Cl. ..... 137/291; 251/151; 24/68 CD; 285/205; 285/320

[58] Field of Search ..... 251/148, 143, 251/151; 137/272, 291, 798, 294, 296; 285/320, 311, 312, 205, 139.1, 139.2, 139.3; 24/68 CD, 265 CD

[56] References Cited

U.S. PATENT DOCUMENTS 2,100,457 11/1937 Trott ..... 251/151
3,476,357 11/1969 Lee ..... 251/151
4,171,095 10/1979 Filan et al. ..... 251/148 X
4,307,746 12/1981 Rifat ..... 137/291
4,412,655 11/1983 Noble ..... 239/183

*Primary Examiner*—Kevin Lee
*Attorney, Agent, or Firm*—Alford's Irrigation Fittings, Inc.

[57] ABSTRACT

A irrigation hydrant particularly adapted for attaching to an above ground valve assembly. Comprised of a cylindrical body with an internally threaded centrally located hub and a gasket, mounted coaxially on a vertical stand pipe, having a valve plate with a coaxially rotatable screw and a handle assembly centrally located and attached to the valve plate for opening and closing the valve. The irrigation hydrant comprised of a of a cylindrical body assembly with one or more tubular pipe couplers. Including two or more mechanisms for releasably attaching to an standard above ground irrigation valve and a coaxially rotatable and slidable handle and yoke assembly for opening and closing the valve while hydrant is clamped to the valve.

1 Claim, 6 Drawing Sheets

CLAMPING STRUCTURE FOR AN IRRIGATION HYDRANT VALVE HOUSING

BACKGROUND OF THE INVENTION

This invention relates to improvements in irrigation hydrants.

Irrigation hydrants are used to distribute water from irrigation valves to other locations for irrigation purposes. These valves are usually mounted on a riser pipe which rises out of the ground vertically to a height of two to four feet and have a valve handle mounted on a stem which when turned raises a valve plate and allows water to flow radially around and in the general vicinity of the valve. If water is to be directed to another location it is necessary to install an irrigation hydrant. This makes it necessary to frequently install and remove irrigation hydrants. Hydrants are generally installed with "J" bolts and nuts which must be tightened with a tool and is very time consuming and difficult. The several nuts must be tightened to the same torque to insure a leak free connection.

Other objects and advantages of the present invention will be set forth hereinafter in the description relating to the several views in the accompanying drawings.

DETAILED DESCRIPTION OF THE PREFERRED EMBODIMENT

Figure 1:
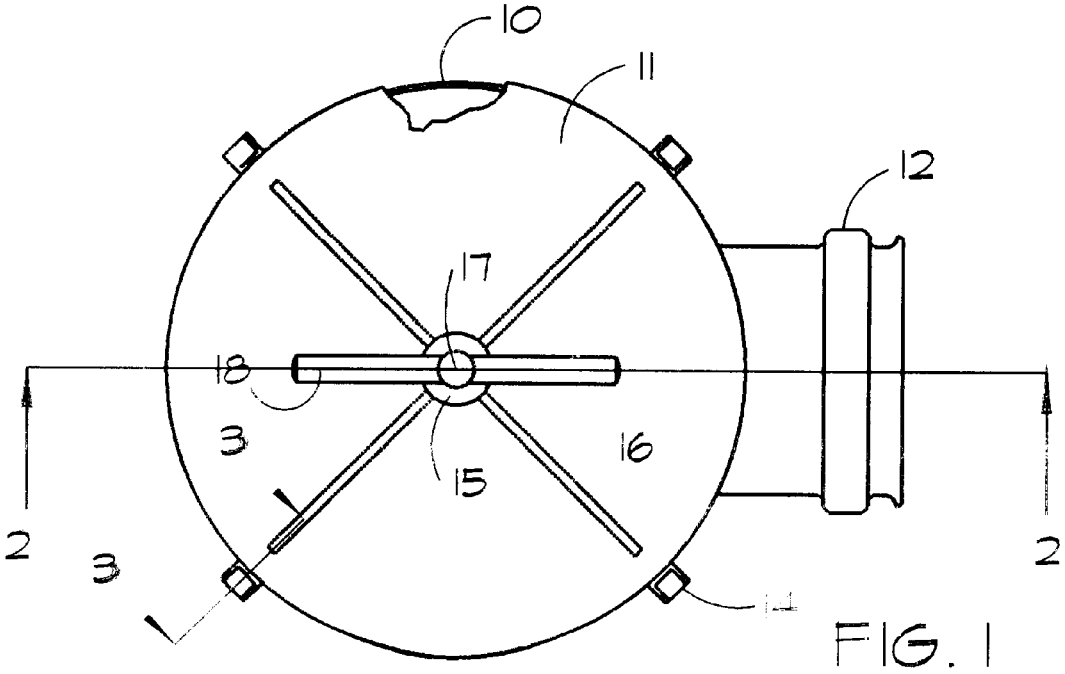
FIG. 1 is a top view of the hydrant.
Figure 2:
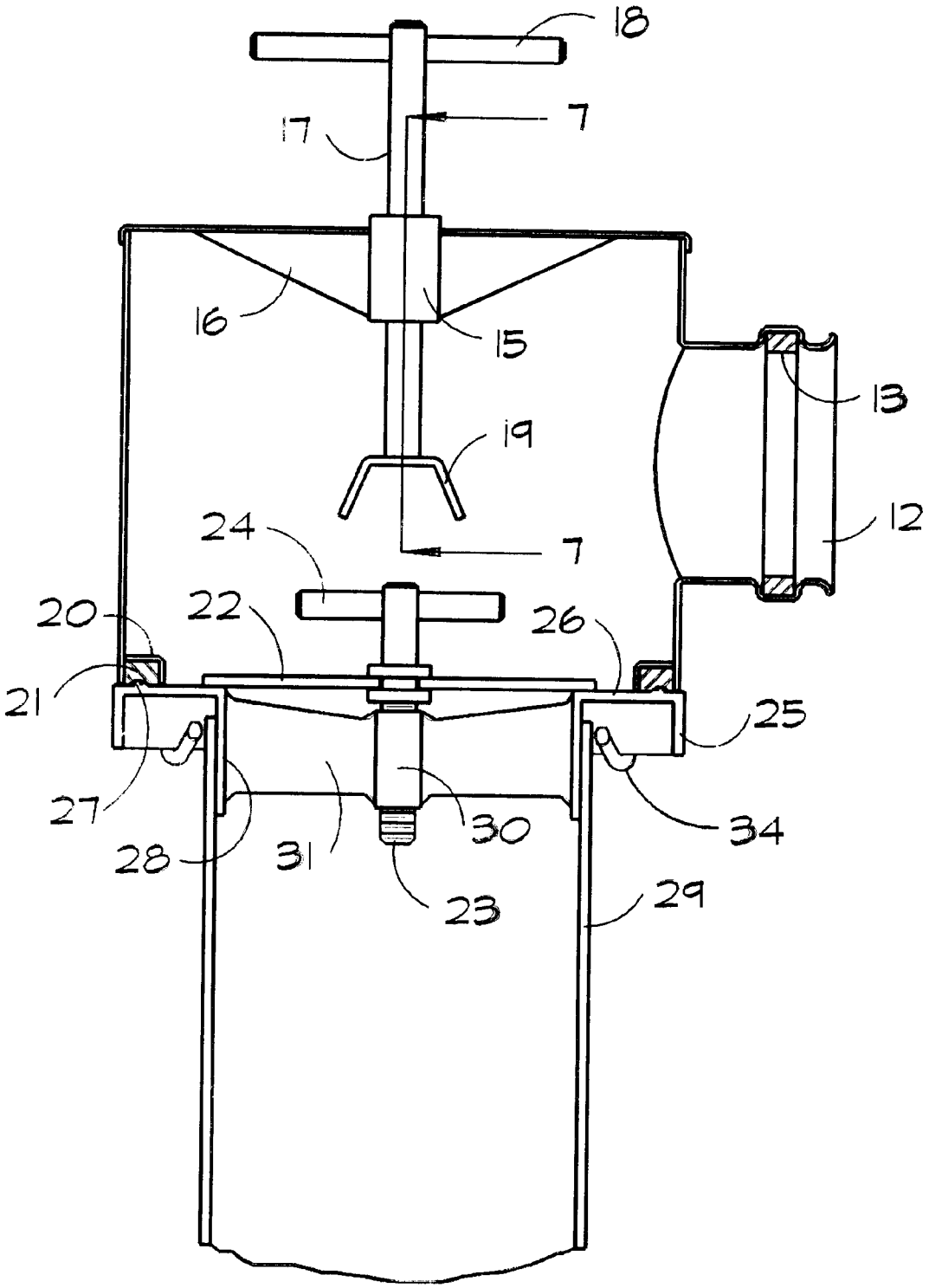
FIG. 2 is a fragmentary cross section taken at line 2—2 of FIG. 1, showing the hydrant mounted on an irrigation valve.
Figure 3:
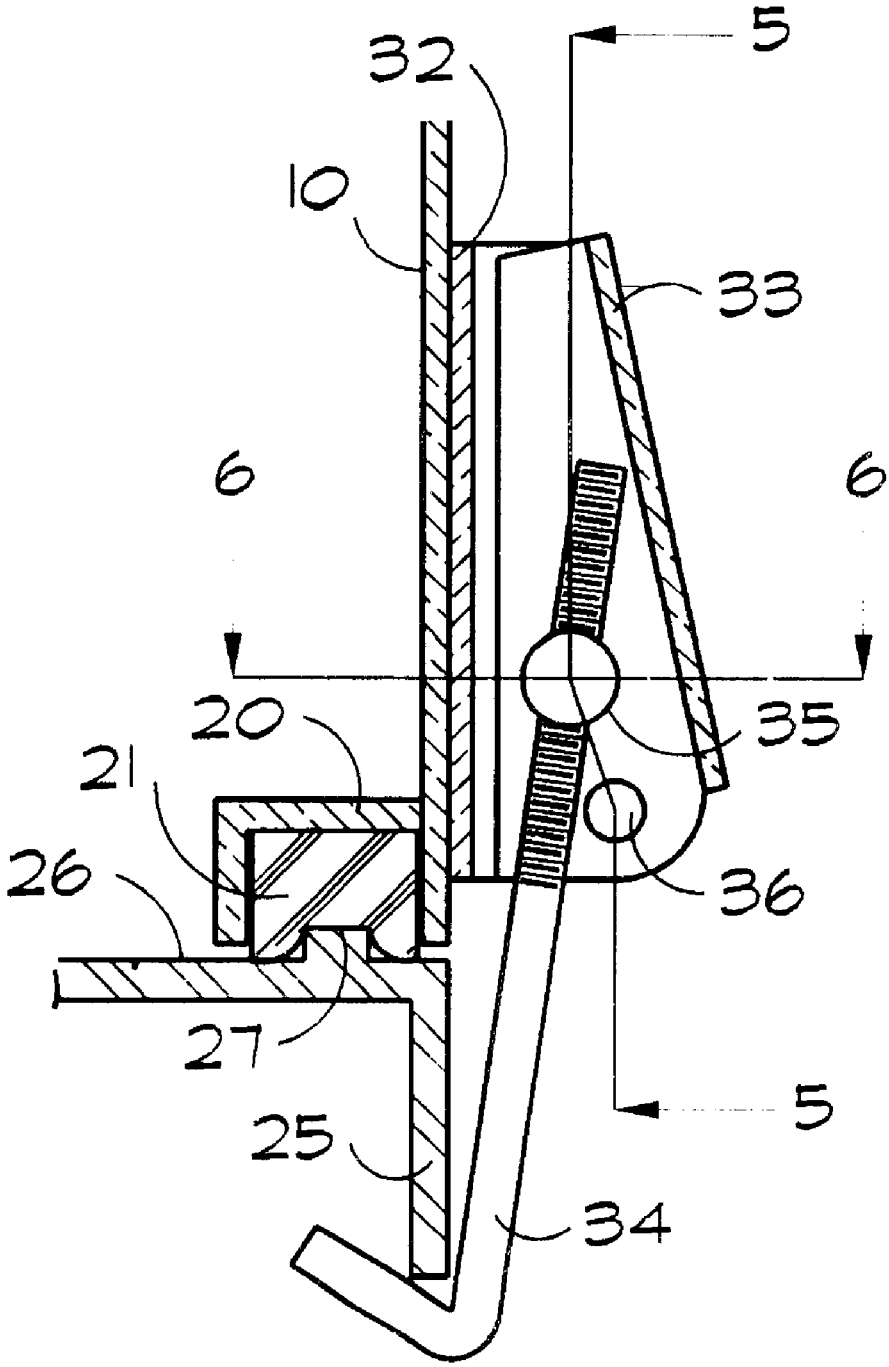
FIG. 3 is a fragmentary cross section taken at line 3—3 of FIG. 1, showing the hydrant-securing clamp in the clamped position.
Figure 4:
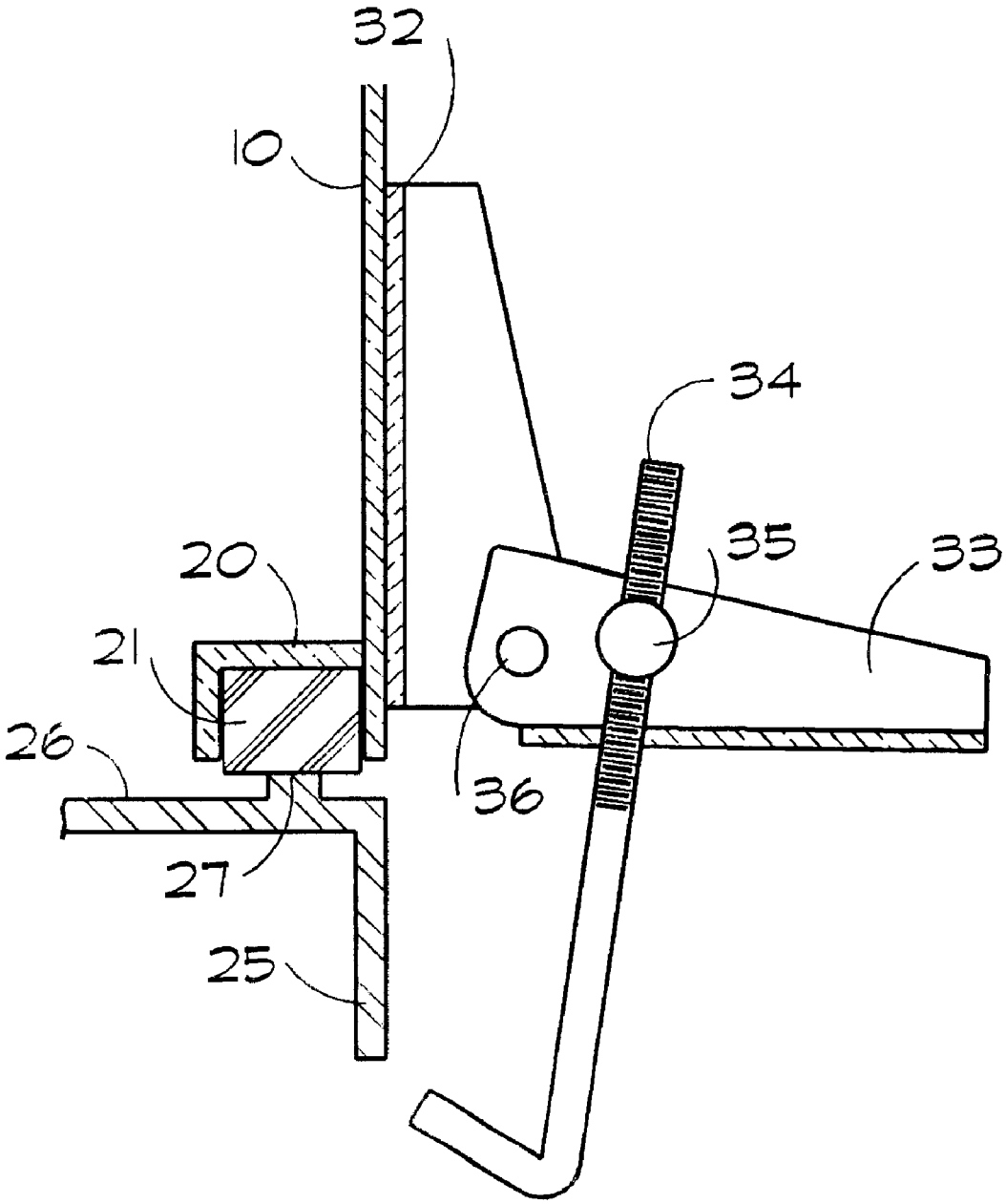
FIG. 4 is a fragmentary cross section showing the hydrant-securing clamp in the unclamped position.
Figure 5:
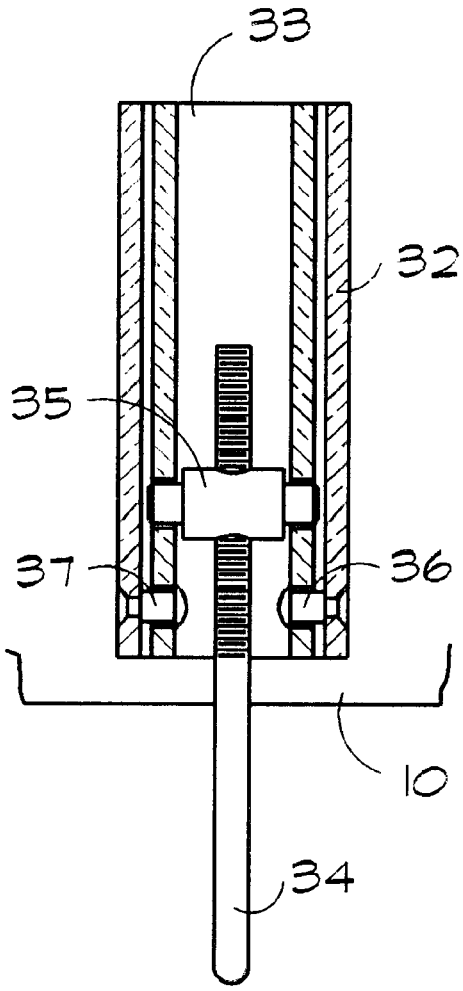
FIG. 5 is a fragmentary cross section taken on line 5—5 of FIG. 3.
Figure 6:
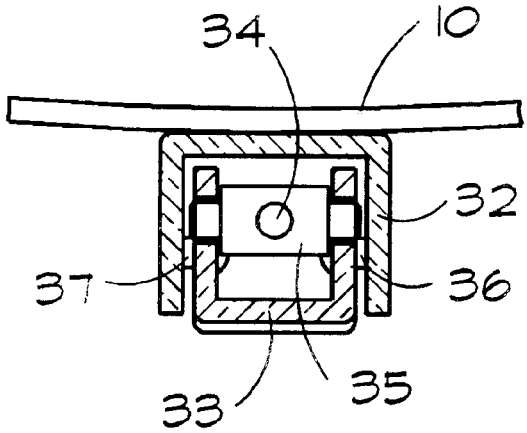
FIG. 6 is a fragmentary cross section taken on line 6—6 of FIG. 3.
Figure 7:
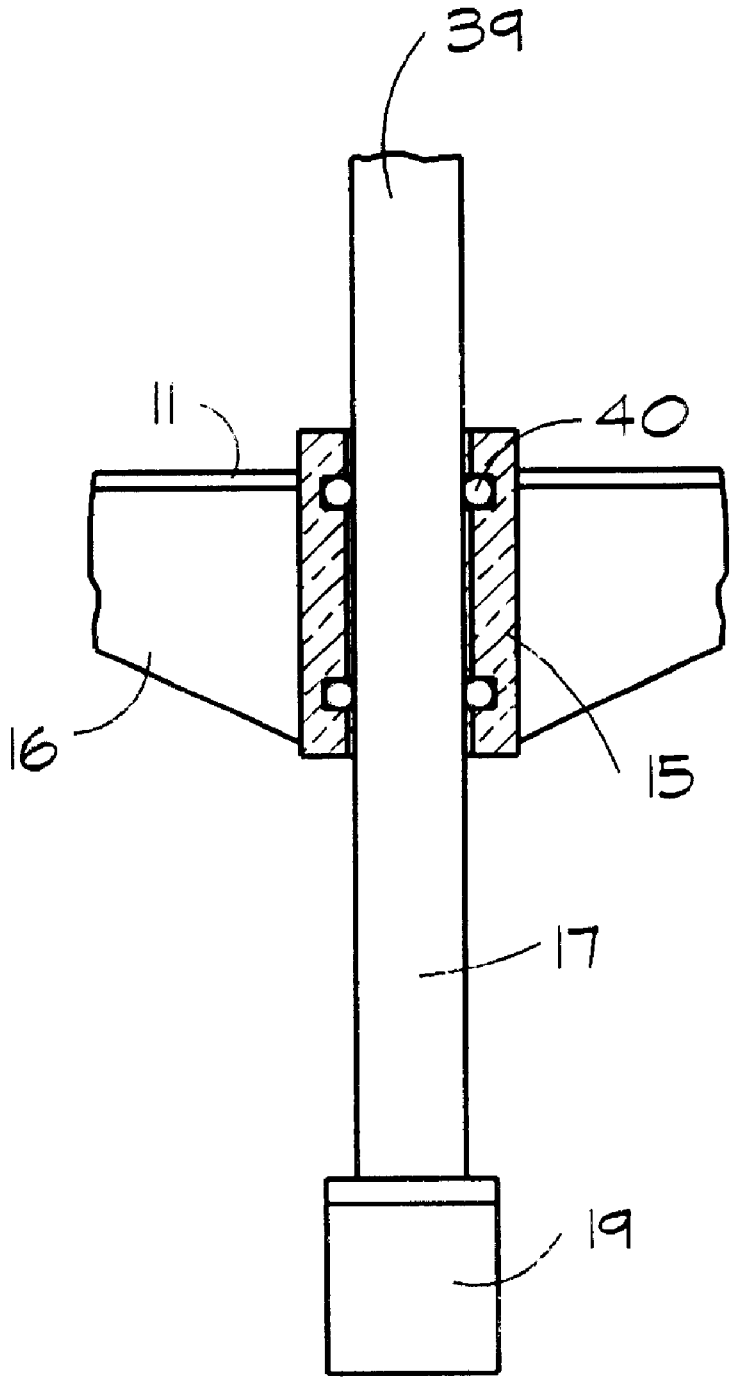
FIG. 7 is a fragmentary cross section taken on line 7—7 of FIG. 2.

Referring more in detail to the drawings in which similar reference characters designate corresponding parts through out the several views, it will be seen the invention consist of a cylindrical body 10, a top plate 11, one or more tubular pipe couplers 12 which have a gasket to prevent leakage when a pipe is inserted into the pipe coupler, a stem guide 15, a plurality of stem guide braces 16, a stem assembly 39, a plurality of securing clamps 14, a seal receiving pocket 20 and a seal 21. The stem assembly 39 consisting of a stem 17, a stem handle 18, and a yoke 19. In FIG. 7 it is observed that a plurality of "O" ring seals 40 are provided between the stem guide 15 and the stem 14, which prevents leakage and allows the stem assembly 39 to be manually moved both radially 360 degrees and linearly in a substantially vertical direction. Referring now to FIG. 2 which shows the hydrant mounted on a typical irrigation valve. A valve generally consist of a valve body 21, a valve plate 22, a threaded valve stem 23 and a handle 24. The valve body typically is a one-piece casting having a tubular shaped outer skirt 25 a top flat surface 26, which has a seal projection 27, a tubular shaped inner skirt 28, a center hub 30 which is internally threaded to receive the threaded valve stem 23 and is supported by two or more radial spokes 31, the valve is commonly mounted on the top of an irrigation stand pipe 29 which extends two to four feet above the ground. Turning the handle 24 thereby opens the valve unscrewing the stem 23 and raising the valve plate 22 allowing the water to flow through the stand pipe 29 and the inner skirt 28 and on through the opening formed between the valve plate 22 and the top flat surface 26 of the valve body 21. The valve may be closed by turning the handle in the opposite direction. The water is supplied to these valves from wells and an electric pump which is turned off when opening and closing the valves. The hydrant is held in place by a plurality of quick release clamps 14, which are shown in detail in FIGS. 3 through 6. The clamps consist of a clamp body 32 which is rigidly attached to the hydrant body 10, a clamp handle 33, a externally threaded "j" bolt 34, a pivot pin 35 which internally threaded to receive the "j" bolt and two hinge pins 36 and 37. The hydrant is clamped to the valve by manually pushing the clamp handle 33 toward the clamp body 32 with the "j" bolt 34 contacting the lower edge 38 of the valve's outer skirt 25. When the central axis of the pivot pin 35 is forced past the central axis of the hinge pins 36 and 37 the clamp handle 33 is forced toward the clamp body 32 due to the pressure exerted on the seal 21 by the seal projection 27. That secures the clamp in place until the clamp handle 33 is manually pulled outward away from the clamp body 32, thereby releasing the "J" bolt from the valves outer skirt 25.

With the hydrant clamped in place the valve may be opened by lowering the stem assembly 39 until the yoke 19 engages the valve handle 24 then by turning the stem assembly 39 the valve stem 23 is screwed upward raising the valve plate 22 and allowing water to flow through the inner skirt 28. Turning the stem assembly 39 in the opposite direction will close the valve.

What is claimed is:

1. An irrigation hydrant for mounting on an irrigation valve for distributing irrigation water, said hydrant comprising in combination:

a body member having a cylindrical side portion and a top portion;

means for connecting an irrigation pipe to said side portion;

a manually operable linearly and radially movable stem means with a handle means and a valve handle engaging means for opening and closing said irrigation valve;

means to support said stem means;

means to seal between said stem means and said support means for preventing leakage;

means to seal between said side portion and said irrigation valve for preventing leakage;

means to secure said hydrant to said irrigation valve, a plurality of securing clamps each consisting of;

a clamp base portion rigidly affixed to said hydrant body member;

a clamp handle portion pivotally linked to said clamp base by hinge pins causing said clamp handle;

means to be forced to move radially in a substantially vertical direction about the central axis of said hinge pins;

a pivot pin pivotally affixed to said clamp handle, said pivot pin having a rotational axis being parallel to said central axis of the hinge pins and having a threaded hole centrally located and at a right angle to the said rotational axis;

a hook means having one end externally threaded to be received by said threaded hole in said pivot pin and the opposite end formed to engage said irrigation valve;

said clamp handle means being rotatable on said central axis of the said hinge pins to move said hook means to clamp and unclamp said hydrant to or from said valve.

* * * * *